US005118554A

United States Patent [19]

Chan et al.

[11] Patent Number: 5,118,554

[45] Date of Patent: Jun. 2, 1992

[54] INTERLEAVED TOWEL FOLD CONFIGURATION

[75] Inventors: Michael Y. Chan, Wallingford; James J. Hipkins, Prospect Park, both of Pa.

[73] Assignee: Scott Paper Company, Philadelphia, Pa.

[21] Appl. No.: 598,261

[22] Filed: Oct. 16, 1990

[51] Int. Cl.[5] ..... B32B 3/04

[52] U.S. Cl. ..... 428/126; 428/130; 428/134; 221/48; 206/494

[58] Field of Search ..... 428/124, 130, 126; 221/48; 206/494

[56] References Cited

U.S. PATENT DOCUMENTS

| | | | |
|---|---|---|---|
| 1,501,662 | 7/1924 | Horwitt | 206/57 |
| 1,675,700 | 7/1928 | Fairchild | 221/48 |
| 1,681,639 | 8/1928 | Hansen | 270/39 |
| 1,698,823 | 1/1929 | Rasmussen | 206/57 |
| 1,706,166 | 3/1929 | Hunt | 206/57 |
| 1,962,762 | 6/1934 | Campbell | 206/57 |
| 2,009,464 | 7/1935 | Winter | 206/57 |
| 2,244,630 | 6/1941 | Metternich | 206/57 |
| 2,477,223 | 7/1949 | West | 206/57 |
| 3,007,605 | 11/1961 | Donovan | 221/47 |
| 3,047,141 | 7/1962 | Burns | 206/57 |
| 3,119,516 | 1/1964 | Donovan | 221/47 |
| 3,199,861 | 8/1965 | Presnell et al. | 270/40 |
| 3,207,361 | 9/1965 | Marcalus | 221/48 |
| 3,285,599 | 11/1966 | Pherson et al. | 270/40 |
| 3,291,477 | 12/1966 | Rehr | 270/39 |
| 3,291,478 | 12/1966 | Couzens et al. | 270/40 |
| 3,291,479 | 12/1966 | Greiner et al. | 270/40 |
| 3,572,681 | 3/1971 | Nystrand | 270/39 |
| 3,845,948 | 11/1974 | Furbeck et al. | 270/40 |
| 3,980,290 | 9/1976 | Sjoman et al. | 270/66 |
| 4,143,762 | 3/1979 | Spiegelberg | 206/210 |
| 4,254,947 | 3/1981 | Trogan | 270/39 |
| 4,548,595 | 12/1985 | Heater et al. | 493/458 |
| 4,623,074 | 11/1986 | Dearwester | 221/48 |
| 4,681,240 | 7/1987 | Wyant | 221/48 |
| 4,811,878 | 3/1989 | Horinchi | 225/46 |
| 4,859,518 | 8/1989 | Schutz | 428/126 |

*Primary Examiner*—Alexander S. Thomas

*Attorney, Agent, or Firm*—John W. Kane, Jr.; Mark G. Bocchetti

[57] ABSTRACT

Disclosed is an interleaved L-fold towel arrangement which minimizes a number of different types of commonly occurring paper towel dispensing failures. Each towel in the interleaved stack of towels in the present invention is comprises of a sheet which has been folded in half to substantially create a two-ply arrangement. A second fold is imparted to the towel substantially to the first fold thereby creating a lead flap and a trailing flap. The lead flap begins with the first fold and thereby creates a tab end which is two-ply and which will not delaminate on dispensing. The user will thus always be grasping a two-ply product as it is being dispensed thereby minimizing tear-out and tab-out failure.

The lead flap preferably has less width than the trailing flap, thus limiting the amount of deformation which must be imparted by the trailing flap to the lead flap next to be dispensed to cause said lead flap to be drawn through the dispensing opening of a dispenser.

12 Claims, 2 Drawing Sheets

INTERLEAVED TOWEL FOLD CONFIGURATION

BACKGROUND OF THE INVENTION

1. Field of the Invention

This invention relates generally to configurations for folded paper towel products and more particularly, to folded, interleaved sheet toweling for dispensing from existing sheet towel dispensers.

2. Brief Description of the Prior Art

The prior art is replete with a variety of fold configurations for use in the sanitary sheet products such as paper towels, tissues and napkins Generally speaking, the different fold configurations have been employed to reduce dimensions, and/or to facilitate dispensing. Known fold configurations include C-fold, V-fold, Z-fold and numerous others which may be generally referred to as folded towels By way of example, an interleaved V-fold towel is shown in U.S. Pat. No. 3,291,479 to Greiner, et.al. and in U.S. Pat. No. 3,845,948 to Furbeck, et.al. Furbeck, et.al. further teaches the method and apparatus for interleaving Z-fold as well as V-fold towels Various other fold configurations are either the subject of or at least displayed in U.S. Pat. No. 4,859,518 to Schutz; U.S. Pat. No. 3,980,290 to Sjoman, et.al.; U.S. Pat. No. 4,548,595 to Heater, et.al.; U.S. Pat. No. 3,119,516 to Donovan; U.S. Pat. No. 3,007,605 to Donovan; U.S. Pat. No. 3,047,141 to Burns; U.S. Pat. No. 2,477,223 to West; U.S. Pat. No. 2,244,630 to Metternich; U.S. Pat. No. 2,009,464 to Winter; U.S. Pat. No. 1,698,823 to Rasmussen; U.S. Pat. No. 1,706,166 to Hunt; U.S. Pat. No. 1,962,762 to Campbell; and U.S. Pat. No. 1,501,662 to Horwitt.

Typically, folded sheet towel products of the type dispensed in lavatories are stacked and banded together as a package for shipment and storage prior to use. Folded towel sheets are loaded into the dispenser as a stack. Often, due to the nature of the particular fold configuration employed, the stack of towels must be loaded with a specific orientation in order to promote convenient and efficient dispensing. For example, a C-fold configuration towel must be positioned with a specific face downward if dispensing is to be convenient and efficient without promoting excessive dispensing failures such as dispensing more than a single sheet at a time. In the case of those which have specific promoting requirements, misloading not only results in inefficient dispensing and dispensing failures, but further often results in the user physically contacting the dispenser through the act of reaching through the dispensing opening to seize one or more sheets. Users often perceive this physical contact with the dispenser as an exposure to bacterial and viral infections and therefore wish to avoid such physical contact.

Another problem encountered in dispensing the paper towels is tab-out. Tab-out is that occurrence where a user with wet hands grasps the towel to be dispensed, for example, between thumb and forefinger. As the user pulls on a small section of towel which is now wet, it may fail such that the user is left with a small "tab" of towel between his thumb and forefinger with the remainder of the towel remaining in the dispenser.

Another problem which is often encountered with some of the more typical towel fold configurations is fall out. Fall out typically occurs as the end of the stack is reached within the dispenser. With a limited number of towels remaining in the dispenser, the user grasps a single towel and as that towel is dispensed, the remaining towels fall out of the dispenser resulting in waste. Fall out is a common problem of C-fold towels.

SUMMARY OF THE INVENTION

It is therefore an object of the present invention to provide an interleaved towel fold configuration which reduces the likelihood of tab-out occurrences.

It is a further object that the present invention to provide an interleaved folded towel configuration which reduces the likelihood of failure.

Yet another object of the present invention is to provide an interleaved folded towel configuration which reduces the likelihood of multiple dispensing failures.

Still another object of the present invention is to provide an interleaved folded towel configuration wherein each towel may be a single ply sheet but dispenses as a double ply sheet and easily remains configured as a double ply sheet.

Another object of the present invention is to provide an interleaved folded towel configuration which reduces the likelihood of discontinuity of dispensing wherein when one sheet is dispensed, the next sheet does not present itself for dispensing.

It is still a further object of the present invention to provide an interleaved L-fold towel configuration which is capable of being dispensed efficiently from a typical C-fold towel dispenser without modification of the dispenser.

Briefly stated the foregoing and numerous other objects, features and advantages of the present invention will become readily apparent upon reading of the detailed description, claims and drawings set forth herein. These objects, features and advantages are accomplished by first folding a sheet substantially in half to provide a two-ply towel, wiper, napkin or other absorbent product. The sheet utilized may be produced from non-woven, natural or synthetic fibers. The two-ply towel has a lead edge which has a fold and a trailing edge which is the two ends of the towel now residing adjacent to one another as a result of the first fold. A second fold is then imparted to the towel parallel to the first fold with the second fold being somewhat offset from the middle of the now two-ply towel such that a trailing flap and a lead flap are created with the trailing flap being longer than the lead flap.

A stack of interleaved towels is created such that residing between the flaps of each towel in the stack is the trailing flap of the towel immediately preceding it and the lead flap of the towel immediately following it. Preferably, the lead flap of each towel in the stack overlaps the lead flap of the following towel in the stack in the range of from about 2 to 2.75 inches. In such manner, as a user grasps the lead or folded edge of the lower most towel in the stack and causes it to be dispensed, the lead or folded edge of the next towel in the stack is automatically pulled through the dispensing slot of the dispenser in readiness for further dispensing.

DETAILED DESCRIPTION OF THE PREFERRED EMBODIMENT

Figure 1:
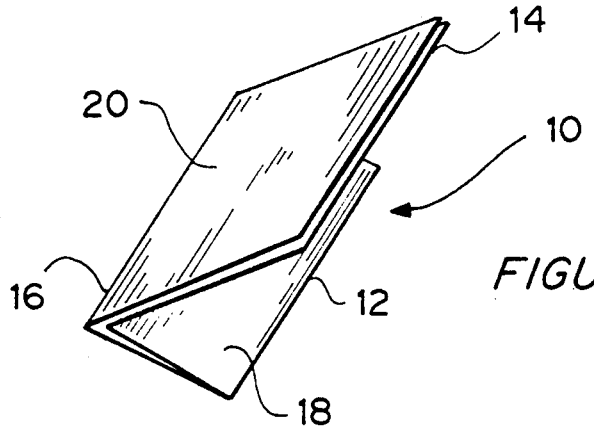
FIG. 1 is an perspective view of a single towel folded into the towel configuration of the present invention.
Figure 2:
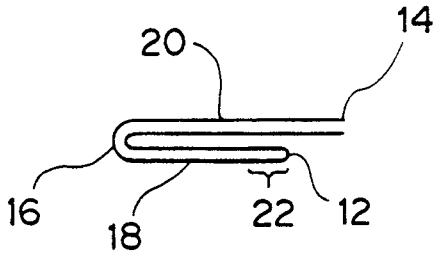
FIG. 2 is end view schematic of a single towel of the fold configuration of the present invention.

Turning first to FIG. 1, there is shown a single towel 10 folded into the towel fold configuration of the present invention. The towel 10 is a single sheet which has been folded in half to create a folded or lead edge 12. The single sheet employed for towel 10 is preferably single ply but may be multi-ply. The towel 10 also has a trailing edge 14 which is formed by the two ends of the towel 10 which now reside in a position adjacent to one another. A second fold 16 is imparted to towel 10 substantially parallel to folded or lead edge 12. Second fold 16, which is a two-ply fold of the preferred single ply towel 10, is somewhat offset toward lead edge 12 thereby creating lead flap 18 and trailing flap 20, both of which are two-ply as a result of the initial fold which created folded or lead edge 12. Off-setting second fold 16 creates a two-ply tab 22 running the width of towel 10 having a lead edge 12 which is folded as shown most clearly in FIG. 2.

Figure 3:
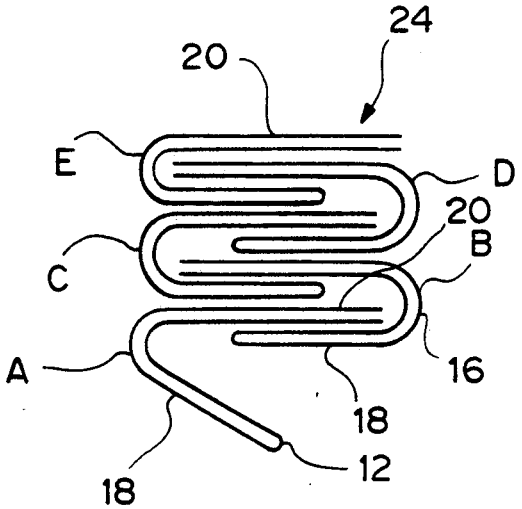
FIG. 3 is end view schematic of an interleaved stack of 5 towels of the fold configuration of the present invention.
Figure 4:
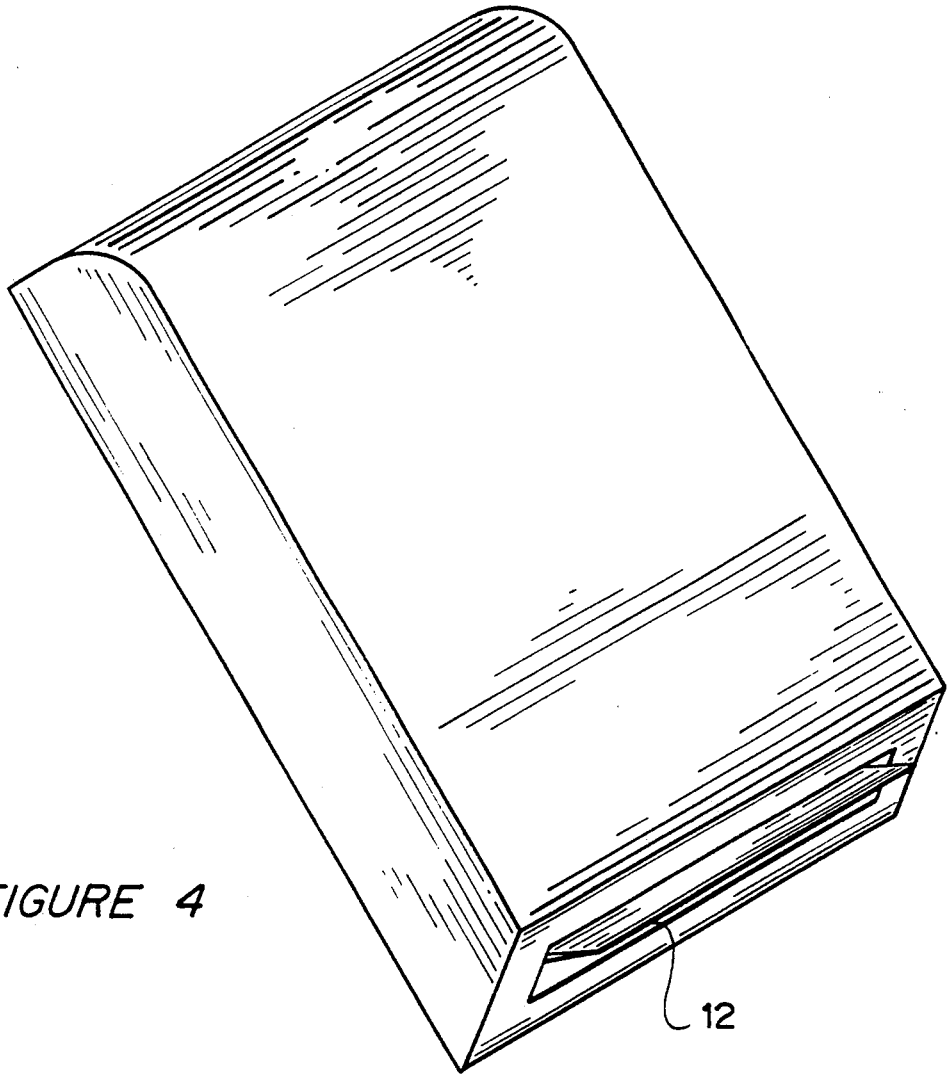
FIG. 4 is an isometric view of a conventional towel dispenser with the lead edge of a single towel of the fold configuration of the present invention extending through the dispensing opening.

Looking next at FIG. 3, there is shown a schematic end view of a stack 24 of five towels 10 of the fold configuration of the present invention. In practice, a stack 24 would preferably comprise from 150 to 300 towels 10. For purposes of clarity, the five towels 10 depicted in FIG. 3 are labelled A, B, C, D and E.

Walking through the dispensing of a few of the towel 10 of stack 24 will illustrate a number of advantages of the present invention. Assuming that the lead edge 12 of towel A is extending through the dispensing opening of the dispenser, user grasps towel A typically somewhere along tab end 22. As the user pulls towel A through the dispensing opening tail or trailing flap 20 of towel A drags lead flap 18 of towel B through the dispensing opening, ready for dispensing next. Because lead flap 18 is shorter than trailing flap 20, the frictional forces between trailing flap 0 of towel A and lead flap 18 of towel B are less than they would be if such flaps 18 and 20 fully overlapped. Further, because lead flap 18 is shorter, leading edge 12 of the towel 10 next to be dispensed is positioned closer to the dispensing opening of the dispenser than would the leading edge of a typical V-fold configuration. As such, less deflection and deformation of lead flap 18 is required to draw it through the dispensing opening. Less force should therefore be required to draw this lead flap 18 of the towel 10 next to be dispensed through the dispensing opening. It is believed that this reduction of forces to overcome by the user minimizes tear-out and tab-out failure of the dispensing of towel A in that less force is required to exert on towel A to pull lead flap 18 of towel B through the dispensing opening. The user may now grab the tab end 22 of towel B causing it to be dispensed.

Again, it is believed that because the lead flap 18 of towel C does not overlap the full length of the trailing flap 20 of towel B, there is not generated the full frictional force as there would be with a typical V-fold arrangement where the lead and trailing flap are of equivalent length. As towel B is dispensed, the lead flap 18 of towel C is pulled through the dispensing opening of the dispenser.

Note that as towel A of FIG. 3 is being dispensed, the lead flap 18 of towel C provides support to towel B to prevent multiple dispensing wherein towel B would be dragged through the dispensing opening simultaneously with towel A creating potential waste. The support provided by lead flap 18 of towel C in retaining towel B is given added rigidity due to the fact that lead flap 18 is double ply. Thus it can be seen that the towel fold configuration of the present invention minimizes the forces which could cause tab-out and tear-out of towel 10 upon dispensing while providing sufficient support to the towel 10 next to be dispensed to prevent multiple dispensing.

The minimizing of frictional forces between the tail or trailing flap 20 of the towel 10 being dispensed and the lead flap 18 of the towel 10 next to be dispensed is an advantage even over a typical two-ply V-fold towel. The L-fold configuration of the towel 10 of the present invention has yet another significant advantage over a laminated two-ply V-fold. It is known that two-ply towels can delaminate. Delamination can occur at the dispensing opening as a result of the forces imparted on the lead end of such an interleaved, laminated or two-ply towel when it is dragged through the dispensing opening of a dispenser by the trailing flap of the towel immediately preceding it. Delamination in such manner may present to the user two (2) lead flaps. If the user grasps a single ply of the two-ply sheet, it is likely to result in a tear-out or tab-out failure of dispensing, particularly if the user's hands are wet. Because the two-ply nature of the towel 10 of the present invention is created by folding a single sheet, and because the tab end 22 is always at the folded or lead edge 12, the user will always be grasping a two-ply tab end 22. The force exerted by the user in dispensing a towel 10 is always transmitted through both plies thereby adding strength and minimizing tab-out failure.

It is known that superior water absorbency is achieved when paper towels are used in a two-ply configuration. The L-fold towel 10 of the present invention promotes such usage even though it may be formed from a single ply sheet. As a towel 10 is dispensed, the action of the trailing flap 20 in pulling the lead flap 18 of the towel next to be dispensed causes the towel 10 being dispensed to open at fold 16. The user is thus presented with an opened two-ply towel of size convenient for use and likely will not be tempted to open the towel 10 further.

The preferred towel 10 of the present invention is designed for use in a typical C-fold dispenser such as Scott Towel Dispenser No. 0995 which has inside dimensions of 3.8" by 10.6". The preferred towel 10 preferably employs a substrate that has a total water absorption (TWA) greater than about 500 grams per square meter of substrate, an absorbency rate (ABS) of less than about ten (10) seconds, a basis weight (BW) ranging from about 40 to about 55 grams per square meter and a composite strength, structural property (SS) ranging from about 550 to about 1000 meters per 25.4 millimeters wide strip. Generally, a 50 grams per square meter (BW) towel having an SS of about 700 is preferred.

As used herein, TWA is a measure of the quantity of water absorbed per square meter expressed in grams per square meter expressed in grams per square meter of towel as used. ABS is a measure of the time required for 0.1 cc of water to be absorbed expressed in seconds. Basis weight (BW) is expressed in grams per square meter (gsm). SS is a composite property equal to the square root of the tensile strength of the web in the machine direction multiplied by the tensile strength of the web in the cross machine direction in grams per 25.4 mm divided by the basis weight.

The advantages of the present invention are illustrated by the following comparison in which the dispensing behavior of a stack 24 of towels 10 is tested under normal conditions using a Scott Paper Company Dispenser No. 0995, such dispenser conventionally employed for dispensing C-fold towels. The stacks 24 of towels used in the test have a BW of about 50 gsm, TWA of about 450 g/m$^2$, an ABS of about 5.0 seconds, and an SS of about 650. Each stack 24 used for testing contained eighty (80 ) towels 10 except as otherwise stated.

All tests were conducted with wet hands and all hands were dispensed by pulling them straight out at about a 45 degree angle to the wall in the vertical direction. All pulls were made at a moderate rate of speed simulating normal use conditions. While the towel stacks employed in the comparison were prepared manually, a variety of folding and interleaving apparatus are known in the art which can be used to generate stack 24 of the present invention.

Table 1 below depicts the results of the tests. The towels used in the tests were folded approximately in half and then folded again as indicated below. The towels of Tests A1, A2, B and C of Table 1 were full sized towels (10.4×13.3"). Towels having dimensions of 10.4"×11" were employed for Test D. Towels having dimensions of 10.4"×10" were employed for Test E. Towels having dimensions of 10.4"×12.6" were employed for example F. Examples A through F have the following, trailing flap width/overlap width in inches: A=3.3/3.3; B=3.55/2.75; C=3.8/2; D=3.5/0.5; E=3.5/no overlap; F=3.0.

TABLE 1

| | % FAILURES RATED BEST TO WORST | | | | | | |
|---|---|---|---|---|---|---|---|
| TEST | C | B | A1 | D | A2 | F | E |
| # Towels Tested | 80 | 80 | 80 | 80 | 80 | 80 | 80 |
| Loss of Flap | 0 | 0 | 0 | 3.75 | 0 | 0 | 0 |
| Multiple Flap | 0 | 0 | 0 | 0 | 2.5 | 3.75 | 0 |
| Multiple Dispensing | 0 | 1.25 | 0 | 1.25 | 0 | 1.25 | 5.0 |
| Fall Out | 0 | 0 | 0 | 0 | 2.5 | 0 | 3.75 |
| Terminal Fall Out | 0 | 0 | 2.5 | 0 | 1.25 | 1.25 | 0 |
| Tearing | 0 | 0 | 0 | 0 | 0 | 0 | 0 |
| Total % Failures | 0 | 1.25 | 2.5 | 5.0 | 6.25 | 6.25 | 8.75 |

1 - With Adapter
2 - Without Adapter

The quality of dispensing was measured in terms of percent failures due to loss of flap, multiple flap, multiple dispensing, fall out, terminal fall out, and tearing on dispensing. As used herein: "loss of flap" means that the dispensing flap of the towel is not extended through the dispensing opening of the dispenser so that no lead flap is readily available for grasping by the user for next dispensing; "multiple flap" means that the lead flaps 18 of more than 1 towel extend through the dispensing opening of the dispenser making it likely that both would be grasped and dispensed; "multiple dispensing" means that as the user dispenses one towel, one or more trailing towels are dispensed with it through the dispensing openings; "fall out" means that as one towel is being dispensed, the next towel to be dispensed falls free from the dispenser typically onto the floor; "terminal fall out" occurs when the remaining few towels in the dispenser fall from the dispenser; "tearing" refers to any tearing or tab-out of the towel as it is dispensed.

As Table 1 shows, best results are obtained when the towel overlap is in the range of from about 2.75" to about 2". Towel overlap as used herein with respect to the present invention is the length that lead flaps 18 of immediately adjacent interleaved towels 10 superimpose upon one another in stack 24. The towels employed in Test C dispensed perfectly and the towels employed in Test B dispensed nearly as well as Test C with the exception of one multiple dispensing episode considered to be an anomaly. A terminal fall out failure occurred with the towels of Test A-1. The same towels were retested in Test A-2 using an adapter within the dispenser. While the terminal fall-out dispensing problem encountered in A-1 was somewhat mitigated when an adapter was used for A-2, the adapter had to be carefully fitted into the dispenser and of a particular size. Further, with the use of the adaptor, as shown in Table 1, total dispensing failure increased. While the failures in the dispensing of Test D were at first thought to be because of loose loading, further investigation indicated otherwise. The towels of Test F did not provide reliable dispensing and the towels employed in Test E dispensed relatively poorly. Note that for "multiple dispensing" and "fall out", the data on Table 1 is expressed as percentages of the total number of towels misdispensed.

The Test C towels were retested, this time using three packets of 80 towels each to produce a total stack 24 of two hundred forty (240) towels. Unfortunately, the last towel of the first and second packets were not interleaved with the first towels of the second and third packets, respectively, resulting in two discontinuities or losses of flap. Otherwise, the towels dispensed perfectly.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A stack of interleaved towels, each towel comprising:

(a) a sheet;

(b) a first fold in said sheet folding said sheet substantially in half;

(c) a second fold in said sheet substantially parallel to said first fold thereby creating a lead flap and a trailing flap, said lead flap beginning with said first fold, wherein said trailing flap of one of said towels in said stack resides between said lead flap and said trailing flap of another of said towels in said stack, said first fold being continuous across said sheet to thereby present a continuous folded edge for grasping by a user.

2. A stack of interleaved towels, each towel as recited in claim 1 wherein:

said first fold substantially creates a two-ply arrangement of said sheet for dispensing.

3. A stack of interleaved towels, each towel as recited in claim 1 wherein:

said trailing flap is longer than said lead flap.

4. A stack of interleaved towels, each towel as recited in claim 3 wherein:

each of said sheets has a basis weight ranging from about 40 to about 55 grams per square meter.

5. A stack of interleaved towels, each towel as recited in claim 4 wherein:

each of said sheets has a composite strength/structure property ranging from about 550 to 1000 meters per 25.4 mm width.

6. A stack of interleaves towels, each towel as recited in claim 5 where:

each of said sheets has a total water absorption greater than about 500 grams per square meter and an absorbency rate of less than 10 second.

7. A stack of interleaved towels, each towel as recited in claim 1 wherein:

said lead flaps of immediately adjacent interleaved towels in the stack overlap in the range of from about 2" to about 2.75".

8. A stack of interleaved towels, each towel as recited in claim 1 wherein:

each of said sheets is produced from non-woven, natural or synthetic fibers or mixtures of natural and synthetic fibers.

9. A stack of interleaved towels, each towel comprising:

(a) a sheet of non-woven material;

(b) a first fold in said sheet folding said sheet substantially in half thereby producing a towel having a two-ply arrangement for dispensing;

(c) a second fold in said sheet substantially parallel to said first fold, thereby creating a led flap and a trailing flap, said lead flap presenting a continuous fold lead edge for grasping by a user of said towel, said second fold being offset toward said first fold.

10. A stack of interleaved absorbent products. each absorbent product comprising:

(a) a sheet of non-woven material;

(b) a first fold in said sheet folding said sheet substantially in half thereby producing a towel having a two-ply arrangement for dispensing;

(c) a second fold in said sheet substantially parallel to said first fold, thereby creating a lead flap and a trailing flap, said lead flap presenting a continuous fold lead edge for grasping by a user of said absorbent product, said lead flap being shorter than said trailing flap.

11. A stack of interleaved towels, each towel comprising:

a sheet having only one single ply fold and only one two ply fold, said single ply fold folding said sheet substantially in half, said two ply fold being substantially parallel to said first fold thereby creating a lead flap and a trailing flap, said lead flap beginning with said single ply fold, wherein said trailing flap of one of said towels resides between said lead flap and said trailing flap of another of said towels in said stack, said single ply fold being continuous across said sheet to thereby present a continuous folded edge for grasping by a user.

12. A stack of interleaved towels, each towel as recited in claim 11 wherein:

said lead flap is shorter than said trailing flap.

* * * * *